US008172204B2

(12) United States Patent
Serafin

(10) Patent No.: US 8,172,204 B2
(45) Date of Patent: May 8, 2012

(54) ROAD SAFETY BARRIER

(75) Inventor: Luigi Serafin, Negrisia di Ponte di Piave (IT)

(73) Assignee: M.D.S. Handels-Und Montagen Gesellschaft m.b.H., Klagenfurt (AT)

( * ) Notice: Subject to any disclaimer, the term of this patent is extended or adjusted under 35 U.S.C. 154(b) by 133 days.

(21) Appl. No.: 11/569,480

(22) Filed: Nov. 21, 2006

(65) Prior Publication Data

US 2007/0194292 A1 Aug. 23, 2007

(30) Foreign Application Priority Data

May 24, 2004 (IT) ..... UD2004A0106
Oct. 25, 2004 (IT) ..... UD20040049 U

(51) Int. Cl.
*E01F 15/00* (2006.01)

(52) U.S. Cl. ..... 256/13.1; 256/65.14; 404/6

(58) Field of Classification Search ..... 256/1, 13.6, 256/DIG. 6, 65.02, 65.14; 404/6, 9; 248/202.21, 248/300; 269/3.03, 43, 901, 904, 3
See application file for complete search history.

(56) References Cited

U.S. PATENT DOCUMENTS

| | | | | | |
|---|---|---|---|---|---|
| 2,005,418 | A | * | 6/1935 | Hayden et. al. | 256/13.1 |
| 2,095,832 | A | * | 10/1937 | Retzke | 52/296 |
| 2,776,116 | A | * | 1/1957 | Brickman | 256/13.1 |
| 3,617,076 | A | * | 11/1971 | Attwood et al. | 403/395 |
| 4,248,025 | A | * | 2/1981 | Kleine et al. | 52/845 |
| 4,460,161 | A | * | 7/1984 | Grenga | 256/13.1 |
| 5,054,954 | A | * | 10/1991 | Cobb et al. | 256/13.1 |
| 5,145,278 | A | * | 9/1992 | Lohrmann | 404/6 |
| 5,443,324 | A | * | 8/1995 | Sullivan | 404/6 |
| 5,531,540 | A | * | 7/1996 | Wasserstrom et al. | 404/6 |
| 5,697,728 | A | | 12/1997 | Camomilla et al. | |
| 5,791,812 | A | * | 8/1998 | Ivey | 404/6 |
| 5,931,448 | A | * | 8/1999 | Sicking et al. | 256/13.1 |
| 6,141,928 | A | * | 11/2000 | Platt | 52/296 |
| 6,619,627 | B2 | * | 9/2003 | Salisbury et al. | 256/1 |
| 6,644,888 | B2 | * | 11/2003 | Ochoa | 404/6 |
| 6,783,116 | B2 | * | 8/2004 | Albritton | 256/13.1 |
| 6,840,706 | B1 | * | 1/2005 | Camomilla et al. | 404/6 |
| 7,100,903 | B1 | * | 9/2006 | Wilson | 256/13.1 |
| 7,243,908 | B2 | * | 7/2007 | Alberson et al. | 256/13.1 |
| 7,494,112 | B2 | * | 2/2009 | Fromm | 256/64 |
| 7,726,632 | B2 | * | 6/2010 | Amengual Pericas | 256/13.1 |

FOREIGN PATENT DOCUMENTS

| | | | |
|---|---|---|---|
| EP | 0 575 705 | | 12/1993 |
| FR | 2704880 | A1 * | 11/1994 |
| GB | 2 377 458 | | 1/2003 |
| WO | WO 2006027394 | A * | 3/2006 |

* cited by examiner

*Primary Examiner* — Michael P Ferguson
*Assistant Examiner* — Nahid Amiri
(74) *Attorney, Agent, or Firm* — Young & Thompson

(57) ABSTRACT

Road safety barrier (10) usable in correspondence with a roadway and consisting of modular elements (11), each of which comprises a skirt (20, 120) having a front surface (27) facing towards the roadway. Each modular element (11) comprises at least a metal upright (12) which lies on a substantially vertical plane and is anchored to the roadway. The skirt (20, 120) is attached on the metal upright (12) in order to arrange, during use, the front surface (27) facing towards the roadway; the metal upright (12) comprises two lateral flanks (13) which diverge towards the front surface (27), and are joined together in a rear zone (35), distant from the front surface (27).

19 Claims, 10 Drawing Sheets

ROAD SAFETY BARRIER

FIELD OF THE INVENTION

The present invention concerns a road safety barrier, used as a lateral protection of a roadway or as a traffic divider, with the aim of preventing vehicles or means of transport in general from leaving the roadway, or changing roadway, in the event of skidding or accident, or at least reducing such risks.

BACKGROUND OF THE INVENTION

A first type of road safety barrier is known, also called the guardrail type, made of metal and comprising a plurality of metal uprights, normally arranged at a constant distance from each other and fixed into the ground, on which an undulating metal sheet is fixed, with an open section, which extends longitudinally with respect to the roadway. A guardrail-type road safety barrier has good structural elasticity which, in the event of an accident, allows high absorption of the shock and an adequate deformation of the barrier itself; however, it is deficient in preventing a passage to the other carriageway when the angle of impact is greater than a certain value. Another disadvantage of this type of barrier is that the open profile metal sheet represents a cutting element that can prove to be very dangerous for people involved in the accident, particularly for motor cyclists.

A second type of road safety barrier is known called the "New Jersey", to identify the particular profile of the modular elements of which it is composed. These modular elements are made either of concrete, or comprise a shaped skirt made of sheet metal of the box-like type, and are coupled together on the sides and anchored to the roadway so as to form a substantially continuous barrier. At the base of the barrier, the "New Jersey" profile provides an inclined surface, converging from the top downwards towards the roadway; if surmounted by the tires of a vehicle, it promotes the return of the vehicle towards the inside of the carriageway, preventing it from hitting the upper part of the barrier, and from crossing into the other carriageway.

In the metal embodiment, the "New Jersey" barrier has constructional disadvantages due to the difficulty of making a large-size box-like structure, and difficulties in transport. Moreover, the skirts attached directly to the ground, which constitute each of the modular elements, have the disadvantage that they do not possess great rigidity against forces of torsion and flexion applied thereon, due to their mainly vertical development and due to the lack of resistant elements which oppose the forces of impact which act with at least a component orthogonal to the part of the skirt that faces towards the roadway.

One purpose of the present invention is to achieve a road barrier that has safety characteristics typical of the "New Jersey" type barriers, and also structural elasticity, resistance to torsion and flexion and resistance to loads similar to those of guardrail-type barriers.

Another purpose of the present invention is to achieve a road barrier of the "New Jersey" type which is easy to install and transfer, and on which maintenance and interventions can easily be made.

Another purpose of the present invention is to achieve an attachment device which allows to obtain greater elasticity in the connection between the uprights of the road barrier and the attachment base, and a greater capacity of absorbing shocks, reducing the risk of the vehicles leaving the road in the event of an accident.

The Applicant has devised, tested and embodied the present invention to overcome the shortcomings of the state of the art and to obtain these and other purposes and advantages.

SUMMARY OF THE INVENTION

The present invention is set forth and characterized in the main claim, while the dependent claims describe other characteristics of the invention or variants to the main inventive idea.

In accordance with the above purposes, a road safety barrier according to the present invention consists of one or more modular elements, each of which comprises at least a metal upright arranged on a substantially vertical plane, able to be attached to a roadway, on which a metal sheet skirt is attached including at least a front surface facing towards the roadway and having a profile of the "New Jersey" type, or similar thereto.

According to a characteristic of the present invention, each of the metal uprights comprises two lateral flanks arranged on a substantially vertical plane, said lateral flanks diverging towards the front surface of the skirt and joined together in a rear zone, distant from the front surface.

Moreover, thanks to this solution, the metal upright, for each of the modular elements, distributes the weight of the skirt uniformly, since the two diverging lateral flanks define a wide supporting surface for the loads and stresses. Furthermore, the support obtained along the two lines defined by the lateral flanks increases the torsion-flexion rigidity of the skirt.

Thanks to the larger supporting surface with respect to that of a conventional-type vertical upright, the distance between two adjacent metal uprights, made according to the present invention, can be very great while the characteristics of safety and resistance of the skirt in any case remain high.

According to an advantageous embodiment, the skirt has at least a longitudinal rib, advantageously two or more, such as to be at least partly facing towards the metal upright. The ribs not only stiffen the skirt and increase resistance to impacts, but also allow to make the coupling with the relative metal uprights more easy, on which corresponding positioning hollows are made for the ribs.

According to one embodiment of the invention, the metal upright comprises a base, arranged on the ground, in which guide means are made, able to cooperate with mating anchoring means. The guide means comprise two walls facing upwards and slightly separated from each other, so as to define a track or guide along which the anchoring means are able to slide. The latter advantageously comprise a trolley or slider having holes to accommodate attachment elements to the roadway. The attachment elements are attached to the ground in the space between the two walls facing upwards of the base of the metal upright. In this way, the latter is anchored to the ground without being fixed to it directly, and this allows to keep a certain play in the sliding, which increases the elastic resistance of the barrier in the event of shocks.

According to another characteristic of the present invention, the anchoring means comprise at least a metal plate, shaped so as to define at least two lateral segments and an intermediate segment arranged between the two lateral segments and raised with respect to the latter.

The two lateral segments are connected so that they rest, during use, on a supporting surface of an attachment base associated with the roadway, and to be fixed to the attachment base by means of first attachment means.

The intermediate segment functions as a support for the upright, which is attached thereto by means of second attachment means and is arranged, during use, raised with respect to the supporting surface, defining an empty space between its lower surface and the supporting surface itself.

Thanks to the particular shape of the metal plate, the upright is attached thereto in a substantially elastic manner and not rigid as in traditional embodiments, thanks to the space between the intermediate segment and the supporting surface.

In this way, inserted in a road barrier, the shaped metal plate guarantees a greater capacity to absorb the shocks, further reducing the risk of the vehicles leaving the road in the event of an accident.

According to a variant of the present invention, each of the lateral segments is connected with the intermediate segment by means of an inclined wall, which can be rectilinear, segmented or otherwise.

According to another variant, the lower surface of the intermediate segment and the supporting surface define a space able to contain at least a portion of the second attachment means, for example a screw, a nut or other.

According to another variant of the present invention, in the intermediate segment of the metal plate at least a hole is made, able to accommodate a threaded element of the second attachment means.

Moreover, apertures are made in the lateral segments, able to accommodate respective first threaded elements, for example screws, of the attachment means.

The apertures advantageously have an oblong shape, for example elliptical or rectangular, with the longitudinal axis substantially parallel to the longitudinal axis of the roadway.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
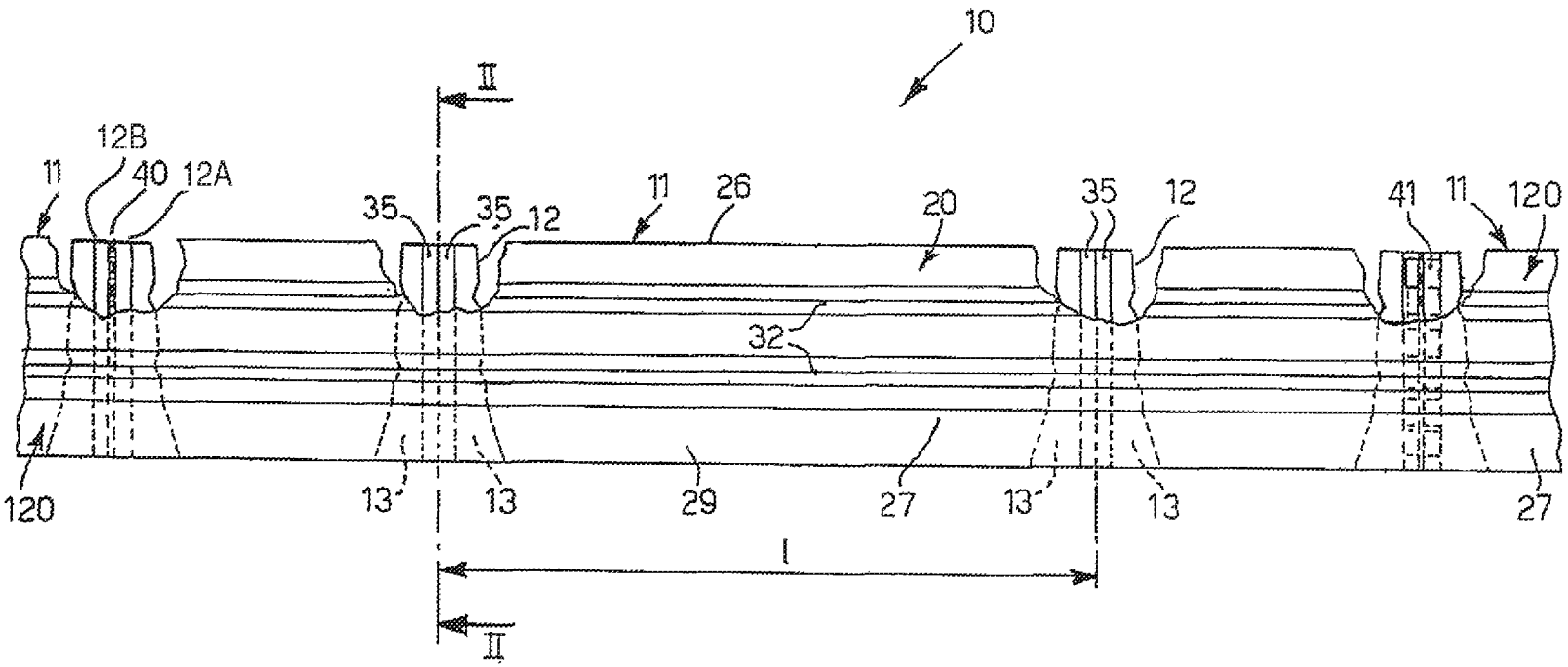
FIG. 1 is a front view of a road safety barrier according to the present invention.

With reference to FIG. 1, a road safety barrier 10 according to the present invention comprises a plurality of modular elements 11 arranged adjacent with each other so as to form a continuous barrier.

Figure 2:
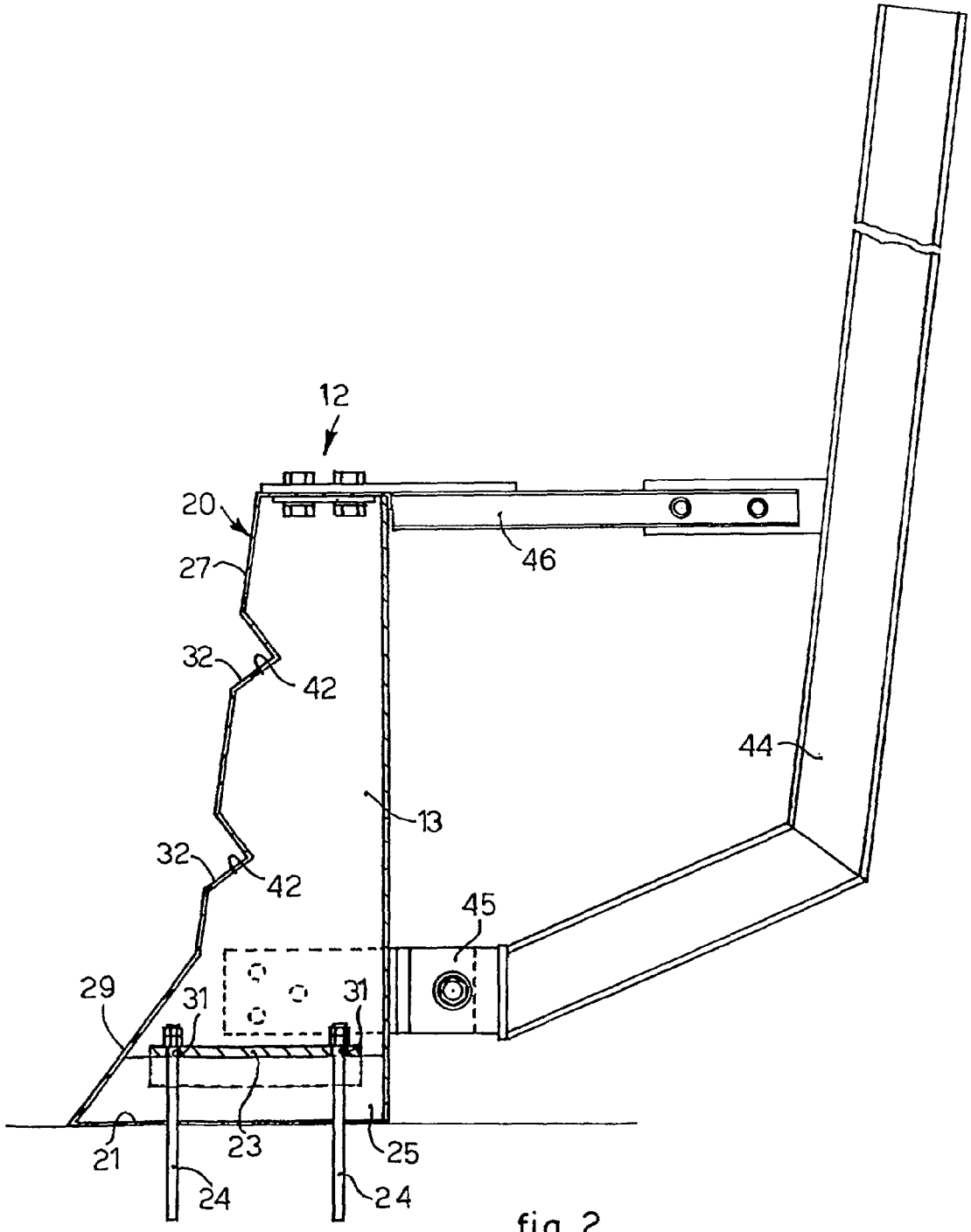
FIG. 2 is a section from II to II of FIG. 1.
Figure 4:
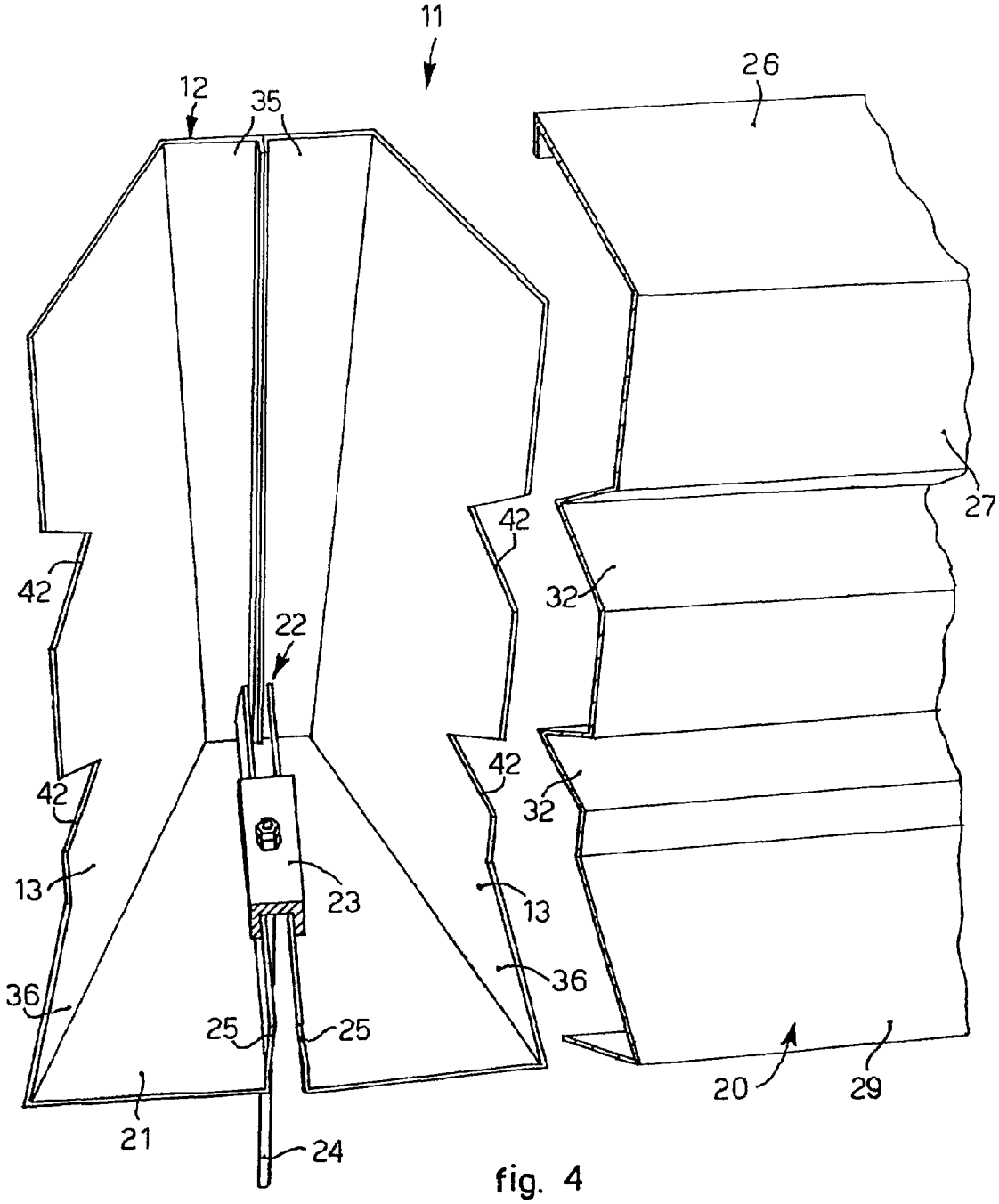
FIG. 4 is an enlarged detail of FIG. 1.
Figure 5:
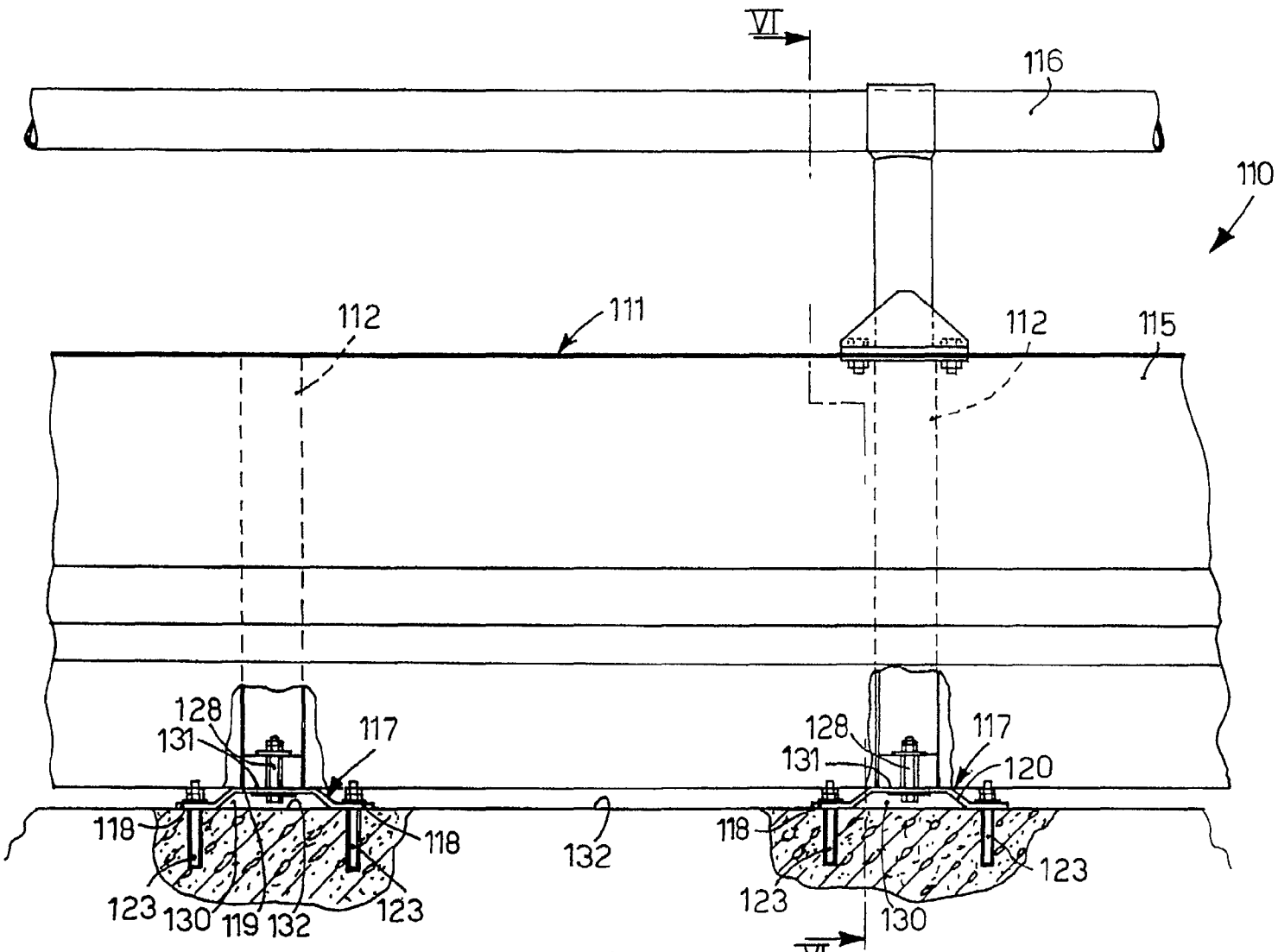
FIG. 5 is a front view, partly in section, of a road safety barrier which employs two metal attachment plates.
Figure 6:
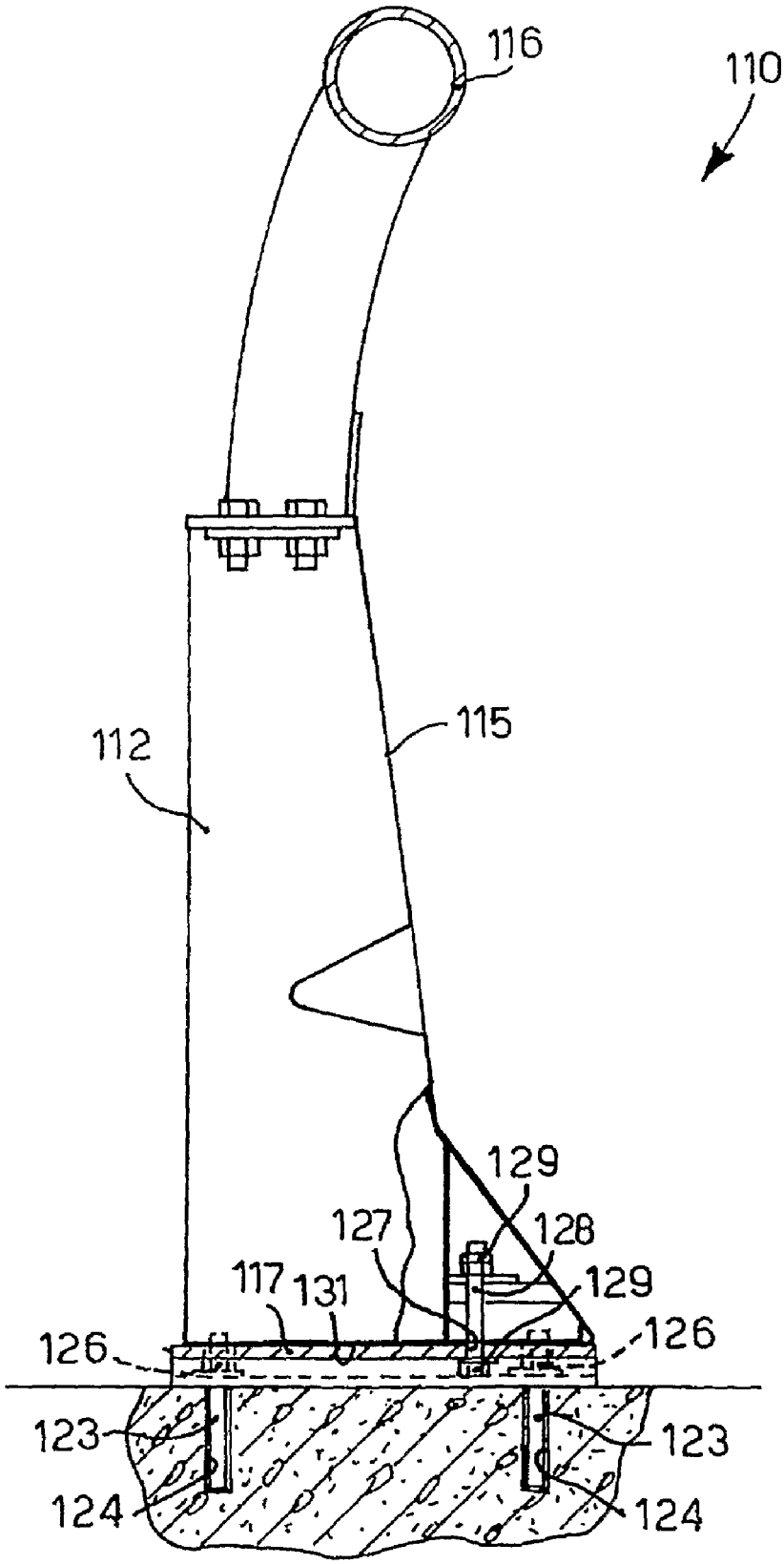
FIG. 6 is a section from VI to VI of FIG. 5.
Figure 7:
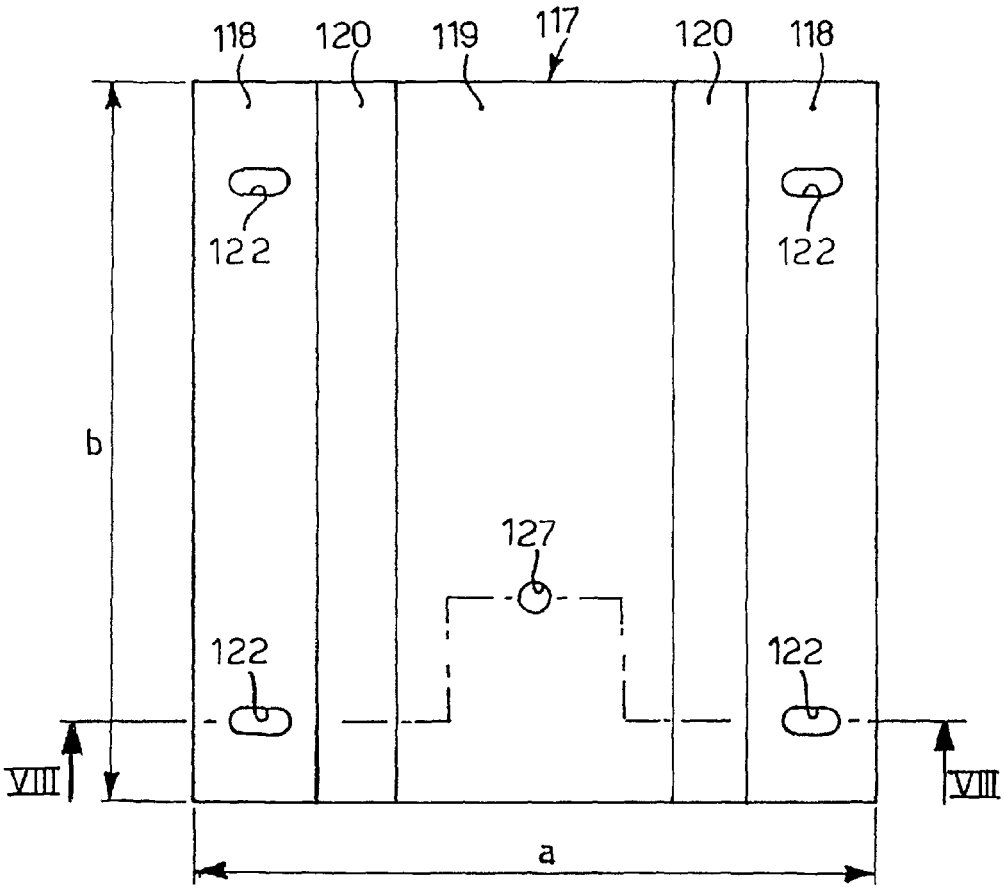
FIG. 7 is a plane view of the metal plate in FIG. 5.
Figure 8:
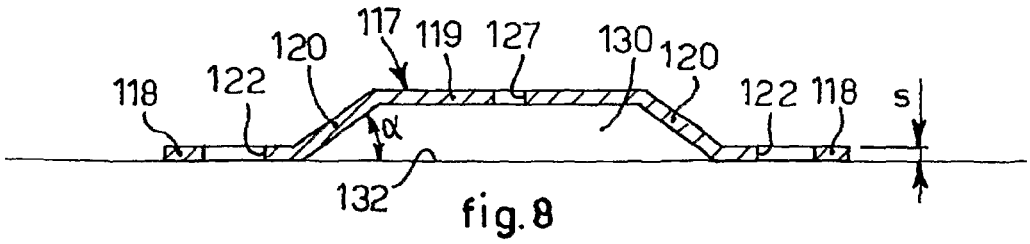
FIG. 8 is a lateral section from VIII to VIII of the metal plate in FIG. 7.

Each modular element 11 comprises, in this case, a pair of metal uprights 12 to which a sheet metal skirt 20 is attached, having a front surface 27 facing towards the roadway. Each of the metal uprights 12 comprises a substantially plane base 21 (FIGS. 2 and 4), located in contact with the roadway and by means of which, as will be explained later, the respective metal upright 12 is attached to the roadway. Alternatively, between the base 21 and the roadway a slab or thickness can be inserted, not shown in the figures.

According to the invention, each metal upright 12 comprises two lateral flanks 13 arranged divergent towards the front surface 27 of the skirt 20 and joined in a rear zone 35, distant from the skirt 20, so as to form substantially a V-shape. The two lateral flanks 13 lie on respective vertical planes and the intersection of said planes substantially defines the rear zone 35.

The flared shape of the metal upright 12 defines a supporting zone for the skirt 20 which is very extensive compared with conventional solutions, guaranteeing a greater resistance to torsion also thanks to its box-like shape.

Figure 3:
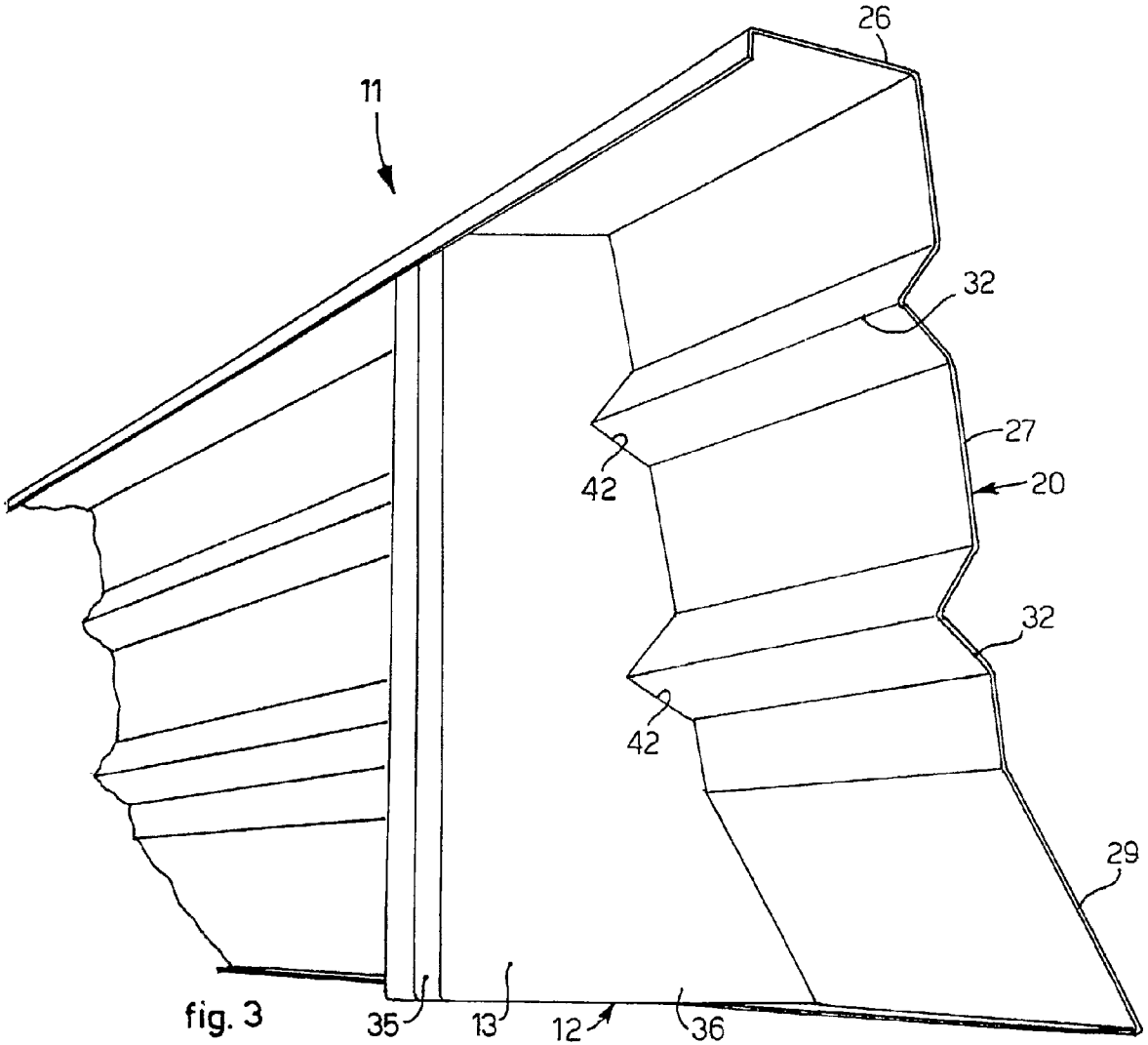
FIG. 3 is a rear view of the road safety barrier in FIG. 1.

The skirt 20 also comprises two longitudinal ribs 32 (FIG. 3) made by bending and with the top facing towards the metal upright 12. Along each of the two lateral flanks 13 two hollows 42 are made, mating with the ribs 32, in each of which the ribs 32 are positioned, which facilitates the operations of assembling and coupling the skirt 20 and the metal uprights 12. A lower part 29 of the skirt 20 is also inclined towards the inside of the metal upright 20 and in the same way each of the two lateral flanks 13 is also inclined.

Each of the two lateral flanks 13 comprises a lower zone 36 (FIG. 4) joined to the base 21, for example by welding, or alternatively made in a single piece by bending the base 21. This allows to obtain a desired inclination of each of the two lateral flanks 13 with respect to the base 21. In a preferential embodiment, the lateral flanks 13 are substantially orthogonal to the base 21.

To give a non-restrictive example, each module of the skirt 20 is about 6 m long (FIG. 1). At about 1.5 m from a first end of the skirt 20 a first metal upright 12 is positioned, whose two lateral flanks 13, in correspondence with the contact with the skirt 20, are about 0.5 m distant from each other. At a distance from the first metal upright 12 of about 3 m, a second metal upright 12, identical to the first, is attached. A second end of the skirt 20 is at about 1.5 m from the second metal upright 12. While achieving the same resistance, the road safety barrier 10, made according to the present invention, allows to reduce the number of metal uprights 12 with respect to conventional guardrail type barriers, for example, which provide vertical uprights of a conventional type. In fact, to support a sheet of the conventional type, 6 m long, at least 3 metal uprights of a conventional type are required, instead of two as in this case.

In order to make a continuous barrier 10, the first skirt 20 and second adjacent skirts 120 can be attached to each other, in correspondence with respective adjacent ends, by means of the same metal upright 12 so that one flank 13 of the upright 12 is connected to a first skirt 20 and the other flank 13 of the same upright 12 is connected to the second skirt 120.

According to a variant, the metal upright 12 consists of a first 12*a* and a second 12*b* element, each of which comprises a flank 13, wherein the element 12*b* cooperates with the second skirt 120 ad the element 12*a* cooperates with the first skirt 20. The two elements 12*a* and 12*b* are connected to each other in their rear part 35, for example by means of a weld 40 (left part of FIG. 1) or by means of hinges 41 (right part of FIG. 1).

In correspondence with the base 21, the metal upright 12 comprises two walls 25 (FIG. 4) made in a single piece and subsequently subjected to bending, so that they are at least partly orthogonal to the ground. The two walls 25 face upwards and are substantially orthogonal to a longitudinal axis of the skirt 20.

The two walls 25 are able to achieve a guide 22 for a mating slider 23 (FIGS. 2 and 4) shaped substantially like an upside-down U, able to be inserted on the guide 22 and to slide thereon. In an upper part of the slider 23 holes 31 are made, each one able to accommodate a dowel 24, inserted by percussion or screwing into the roadway, in order to anchor the metal upright 12 to the ground.

Thanks to this solution, during the installation of the road barrier 10, in a first step the metal upright 12 is located in a provisional position. Subsequently, the dowels 24 are inserted into the respective holes 31, which are only partly screwed into the roadway, so that the guide 22, and hence the metal upright 12 itself, can move under the slider 23, which is constrained to the dowels 24. In this way the metal upright 12 is free to slide along a line orthogonal to the skirt 20 so as to make possible the correct positioning thereof with respect to the other modular elements 11 of the road barrier 10. The two dowels 24 therefore clamp the metal upright 12 to the roadway, guaranteeing a high resistance to torsion.

According to a variant, the skirt 20 comprises an upper surface 26 joined to the front surface 27 and substantially parallel to the base 21, which extends substantially as far as the rear zone 35 joining the flanks 13, and is attached to it by means of a lip folded downwards; this improves the grip of the skirt in the event of an impact.

According to another variant, behind the metal upright 12 an arm 44 is applied (FIG. 2), able to support an anti-noise barrier or windbreak, of a conventional type. The arm 44 is attached to the lateral flanks 13 by means of a U-shaped support 45 and to the upper surface 26 by means of a horizontal support plate 46. As an alternative to or in cooperation with the horizontal support plate 46, the arm 44 can also be connected in the upper part of the upright 12 by means of a U-shaped support.

In the preferential embodiment, the two lateral flanks 13 are symmetrical with respect to a vertical plane passing through the rear zone 35 and substantially orthogonal to the front surface 27 of the skirt 20. Alternatively, the two lateral flanks 13 have different angles of inclination with respect to said vertical plane. The two lateral flanks 13 can also be both inclined in the direction of motion of the means of transport, or can be inclined in the opposite direction.

According to a variant shown in FIGS. 5 to 8, a road barrier 110 comprises a modular element 111 consisting of two uprights 112, which support a skirt 115.

Each upright 112 is attached at the lower part to an attachment base, which can be the roadway itself, the ground or a concrete slab. In this case, one of the two uprights 112 supports at the upper part a substantially horizontal bar 116 to prevent passage to the other carriageway.

Between a lower end 131 of each upright 112 and a supporting surface 132 of the attachment base, a metal plate 117 is located.

The metal plate 117 (FIGS. 7 and 8) comprises two lateral segments 118 which, during use, are arranged in contact with the supporting surface 132.

The metal plate 117 also comprises an intermediate segment 119 arranged between the lateral segments 118 and raised with respect to the supporting surface, so as to define substantially a fretted form, which determines the presence of a space 130 between the intermediate segment 119 and the supporting surface 132.

Between the intermediate segment 119 and each lateral segment 118 there is an inclined wall 120, whose angle $\alpha$ can vary from a little more than 0° to about 120°. Advantageously, to obtain good elastic characteristics, this angle is comprised between about 35° and about 55°.

The metal plate 117 has a rectangular shape with a width "a" of about 463 mm, a length "b" of about 500 mm and a thickness "s" of about 12 mm.

The width of each lateral segment 118 is about 90 mm, that of the intermediate segment 119 is about 190 mm and that of each inclined wall 120 is about 55 mm.

In each lateral segment 118, in the case shown here, two eyelets 122 are made, having their bigger axis parallel to the longitudinal axis of the roadway and able to accommodate a corresponding screw 123 (FIGS. 5 and 6) which is screwed into a relative screw anchor 124 inserted into the supporting surface 132. The metal plate 117 is anchored to the screws 123 by means of first bolts 126.

In the intermediate segment 119 a hole 127 is made, inside which an attachment screw 128 is inserted and clamped by means of second bolts 129, respectively at a first end, to the metal plate 117 and at the other end to the corresponding upright 112.

Each upright 112 has a hole, not shown here, which in the assembly position is aligned with the hole 127 of the metal plate 117.

The space 130 defined by the lower face of the intermediate segment 119 and the supporting surface 132 is suitably sized so as to accommodate, without interference, the second bolt 129 and the end of the attachment screw 128.

The upper surface of every lateral segment 118 and the lower end 131 of the respective upright 112 define another space in which the first bolts 126 and the ends of the screws 123 are accommodated.

In the event of a vehicle hitting the road barrier 110, the metal plate 117, thanks to its fretted shape and the presence of said space 130, has a great elasticity which allows it to absorb the load transmitted to it by the skirt 115 and deriving from the shock.

This considerably reduces the risk that the attachment screw 128, or the metal plate 117 itself, might break, making the relative upright 112 no longer anchored and hence causing one or more modular elements 111 of the road barrier 110 to turn over, and consequently allow the vehicle to cross into the other carriageway.

Moreover, during the impact, the intermediate segment 119 has a component of displacement directed towards the supporting surface 132 and therefore tends to thrust the two lateral segments 118 in the opposite direction and in the direction parallel to the longitudinal axis of the skirt 115.

Thanks to the arrangement and conformation of the eyelets 122, in the event of an impact the two lateral segments 118 can move laterally substantially without causing interference with the screws 123, for example without breaking them.

To assemble the road safety barrier 110, the metal plate 117 is first arranged in the position of use and then attached to the attachment base by means of the screws 123 and the relative first bolts 126. Each upright 112 is then positioned on the respective metal plate 117 and is attached thereto by means of the attachment screw 128 and the second bolts 129.

If it is necessary to remove the road barrier 110, for example for maintenance, it is enough to unscrew one of the two second bolts 129 from the attachment screw 128 in order to make the uprights 112 removable.

Thanks to the present invention, the operations to assemble and dismantle the road barrier 110 are simplified and facilitated, and thus give savings in times and costs.

It is clear that modifications and variants may be made to the road safety barrier 10 as described heretofore, all of which shall come within the field of protection as defined by the attached claims.

For example, the metal plate 117 can be of any shape, for example polygonal.

The number of eyelets 122, corresponding screws 123 and screw anchors 124 can be other than four.

The number of holes 127 and corresponding attachment screws 128 to attach the uprights 112 to the relative metal plates 117 can be greater than one.

Figure 11:
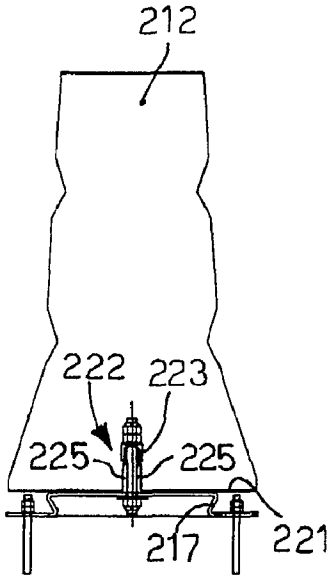
FIG. 11 is a detail of FIG. 9.
Figure 10:
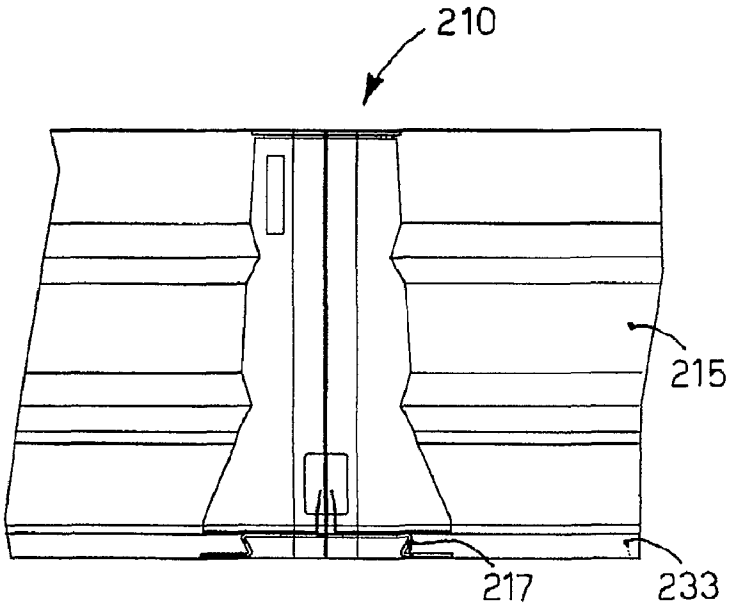
FIG. 10 is a rear view of the variant in FIG. 9.
Figure 9:
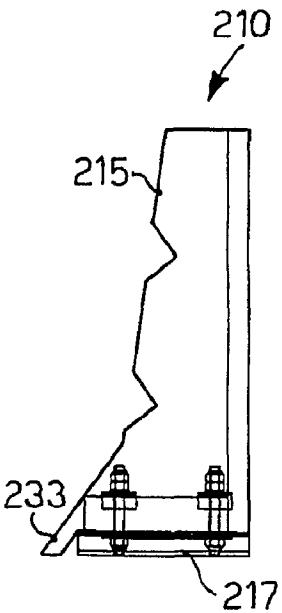
FIG. 9 is a lateral view of a variant of the road barrier in FIG. 1.

According to a variant shown in FIGS. 9, 10 and 11, a road barrier 210 according to the present invention comprises a metal plate 217 and a fold 233 which departs below from a skirt 215 until it contacts, or almost contacts, the roadway.

According to this variant, the base 221 of the upright 212 comprises two walls 225 defining a guide 222 with which a slider 223 is associated, able to slide on the guide 222, and be clamped to the metal plate 217 by means of two attachment screws and two bolts.

Figure 12:
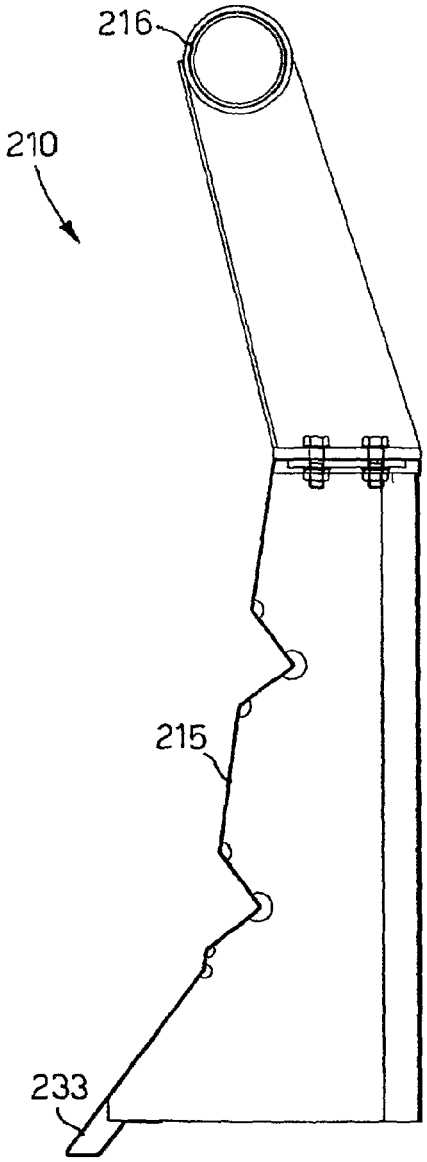
FIG. 12 is a variant of the road barrier shown in FIG. 6.

According to the variant shown in FIG. 12, the road barrier 210 comprises a bar 216 to prevent vehicles from crossing into the other carriageway.

Figure 13:
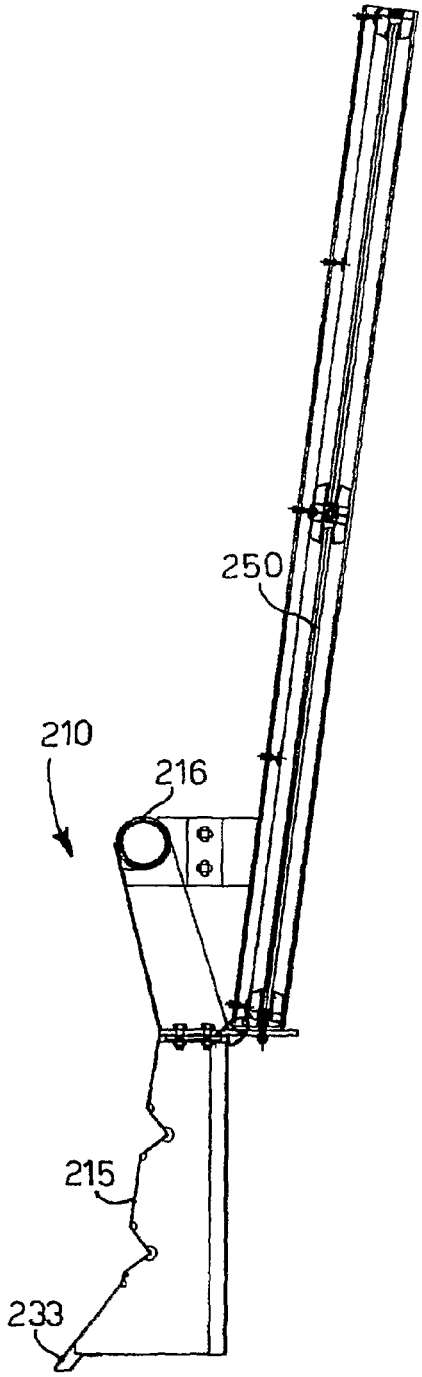
FIG. 13 is a variant of the road barrier shown in FIG. 12.

According to the variant shown in FIG. 13, apart from the bar 216, the road barrier 210 comprises an anti-noise barrier and/or windbreak 250.

Figure 14:
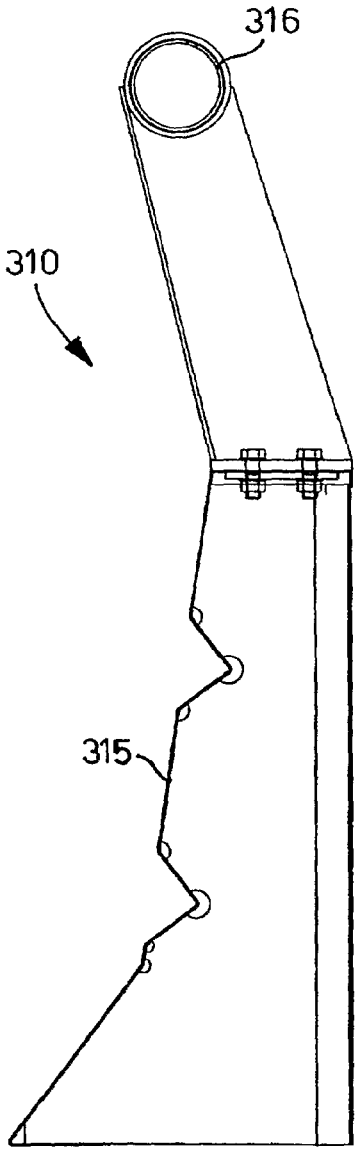
FIG. 14 is another variant of the road safety barrier shown in FIG. 13.
Figure 15:
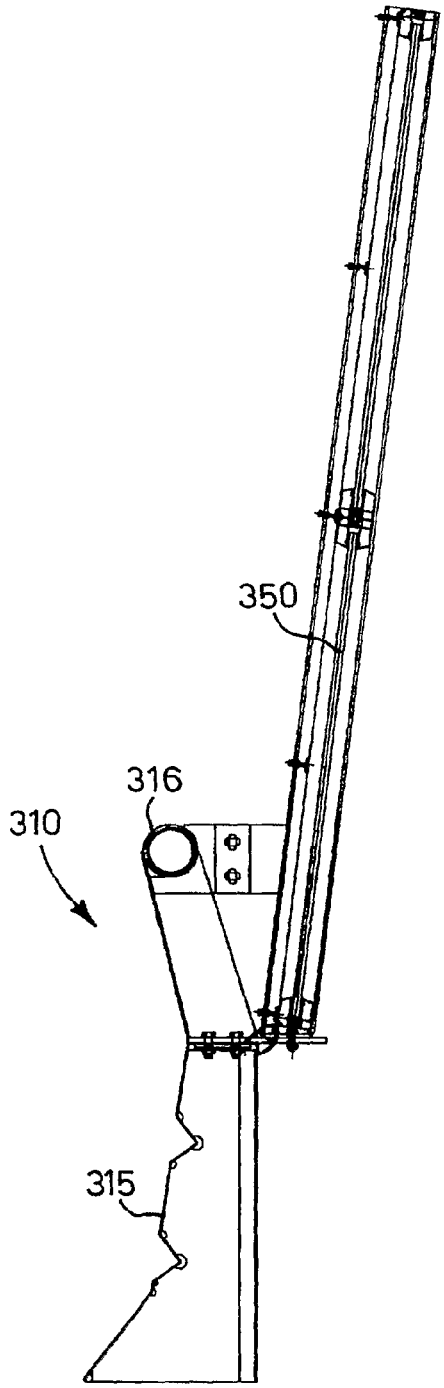
FIG. 15 is a further variant of the road safety barrier shown in FIG. 13.

According to the variant shown in FIG. 14, a road barrier 310 according to the present invention comprises a skirt 315 and a bar 316 to prevent vehicles from crossing to the other carriageway and in the variant shown in FIG. 15 it also comprises an anti-noise barrier and/or windbreak 350.

It is also clear that, although the present invention has been described with reference to some specific examples, a person of skill in the art shall certainly be able to achieve many other equivalent forms of road safety barrier, having the characteristics as set forth in the claims and hence all coming within the field of protection defined thereby.

The invention claimed is:

1. A road safety barrier comprising:

an upright (11) comprising two separate lateral flanks (12*a*, 12*b*) joined along a center plane of the upright, one of the lateral flanks (12) of the two separate lateral flanks (12*a*, 12*b*) in reflection symmetry to an other lateral flank of the two separate lateral flanks (12*a*, 12*b*), the one of the lateral flanks comprising:

a bottom wall (21) arranged in a horizontal plane being of greater width at a front edge than a back edge, a back wall (35) arranged on a vertical plane, a bottom edge of the back wall connecting to the back edge of the bottom wall, an inside edge of the back wall connecting to an inside edge of the back wall of the other lateral flank (12) of the two separate lateral flanks (12, 12), and an outer wall (13) arranged on a vertical plane, a back edge of the outer wall connecting to an outer edge of the back wall (35), and a bottom edge of the outer wall connecting to an outer edge of the bottom wall (21), a front edge of the outer wall faces a roadway forming an acute angle relative to the bottom edge of the outer wall;

a skirt attached along the front edge of the outer wall, said skirt conforming to a shape of the front edge of the outer wall; and a guide upon which an anchoring means is placed to mate each of the two separate lateral flanks together, said anchoring means comprises a dowel to anchor said upright to a roadway, said guide comprises an inner wall arranged on a vertical plane of each of the two separate lateral flanks and attached to an inner edge of the bottom wall substantially orthogonal to the ground and distanced by a space for passage of said dowel, wherein said anchoring means comprises a slider to slide on a top surface of an inner wall of each of the two separate lateral flanks.

2. The road safety barrier as in claim 1, wherein said skirt comprises at least a longitudinal rib facing towards the front edge of the outer wall on each of the two separate lateral flanks.

3. The road safety barrier as in claim 2, wherein, on the front edge of the outer wall on each of the two separate lateral flanks, a corresponding hollow able to accommodate and position said rib.

4. The road safety barrier as in claim 1, comprising a second anchoring means to anchor an anti-noise and/or windbreak barrier to said upright.

5. The road safety barrier as in claim 1, wherein said skirt further comprises an upper surface joined to a front surface of said skirt facing towards a roadway and perpendicular to the back wall, arranged during use substantially to cover an upper part of said upright.

6. The road safety barrier as in claim 1, wherein said two separate lateral flanks have different angles of inclination with respect to a vertical plane passing through rear zone and orthogonal to a front surface of said skirt.

7. The road safety barrier as in claim 1, comprising, in correspondence with the two separate lateral flanks, said upright shared between one skirt and an adjacent skirt.

8. The road safety barrier as in claim 7, wherein a shared upright is made in two parts, each cooperating with a relative skirt joined together by a weld or by means of hinges.

9. The road safety barrier according to claim 1, wherein said upright (12) comprising: a first lateral flank (12*a*) and a second lateral flank (12*b*) each of which comprises the outer wall (13), the two separate lateral flanks are connected to each other in a back wall (35).

10. A road safety barrier usable in correspondence with a roadway comprising:

modular elements, each modular element of said modular elements comprising:

at least a metal upright lying on a substantially vertical plane and able to be anchored to said roadway, with which a skirt is able to be associated in order to arrange, during use, a front surface facing towards said roadway, and wherein said metal upright comprises two separate lateral flanks joined along a center plane of the metal upright, the two separate lateral flanks diverge towards and are in contact with said skirt having said front surface, and are joined together in a rear zone, distant from said skirt having said front surface, and a guide upon which an anchoring means is placed to mate each of the two separate lateral flanks together, said anchoring means comprises a dowel to anchor said upright to a roadway, said guide comprises an inner wall arranged on a vertical plane of each of the two separate lateral flanks and attached to an inner edge of a bottom wall substantially orthogonal to the ground and distanced by a space for passage of said dowel, wherein said skirt having said front surface facing towards said roadway, said front surface having a lower zone inclined towards said roadway, wherein each upright is attached to an attachment base by means of a metal plate shaped so as to define at least two lateral segments and an intermediate segment arranged between said two lateral segments and raised with respect to said two lateral segments, wherein said two lateral segments are able to rest during use on a supporting surface of said attachment base, and said attachment base of a first lateral segment of said two lateral segments is attached to said attachment base of a second lateral segment of said two lateral segments by means of first attachment means, and wherein said intermediate segment is able functions as a support for said upright, since said upright is attached to said intermediate segment by means of second attachment means, wherein each lateral flank of the two separate lateral flanks is formed from a single piece of material, and wherein said anchoring means comprises a slider to slide on a top surface of an inner wall of each of the two separate lateral flanks.

11. The road safety barrier as in claim 10, wherein between said intermediate segment and said supporting surface there is a space to contain at least a portion of said second attachment means.

12. The road safety barrier as in claim 10, wherein at least a hole is made in said intermediate segment and that accommodates at least a threaded element of said second attachment means.

13. The road safety barrier as in claim 10, wherein each of said lateral segments is connected to said intermediate segment by means of a wall inclined according to a desired angle of inclination.

14. The road safety barrier as in claim 13, wherein said angle of inclination ($\alpha$) of said walls is comprised between about 0° and about 120°.

15. The road safety barrier as in claim 13, wherein said angle of inclination (a) of said walls is comprised between about 35° and about 55°.

16. The road safety barrier as in claim 10, wherein apertures are made in said lateral segments and that accommodates respective first threaded elements of said attachment means, and wherein said apertures have an oblong shape having a longitudinal axis substantially parallel to the longitudinal axis of said roadway.

17. A road safety barrier usable in correspondence with a roadway comprising:

modular elements, each of the modular elements comprising:

at least a metal upright lying on a vertical plane and able to be anchored to said roadway, with which a skirt is able to be associated in order to arrange, during use, a front surface of said skirt facing towards said roadway, and wherein said metal upright comprises two separate lateral flanks joined along a center plane of the metal upright, the two separate lateral flanks diverge towards and are in contact with said skirt having said front surface, and are joined together in a rear zone, distant from said skirt having said front surface; and a guide upon which an anchoring means is placed to mate each of the two separate lateral flanks together, said anchoring means comprises a dowel to anchor said upright to a roadway, said guide comprises an inner wall arranged on a vertical plane of each of the two separate lateral flanks and attached to an inner edge of a bottom wall substantially orthogonal to the ground and distanced by a space for passage of said dowel, wherein said front surface having a lower zone inclined back from a base of the lower zone towards said rear zone forming an acute angle between the base and said roadway, wherein each lateral flank of the two separate lateral flanks is formed from a single piece of material, and wherein said anchoring means comprises a slider to slide on a top surface of an inner wall of each of the two separate lateral flanks.

18. The road safety barrier as in claim 17, wherein said skirt comprises at least a longitudinal rib facing towards said metal upright.

19. The road safety barrier as in claim 18, wherein, on each of said lateral flanks, said metal upright has at least a corresponding hollow able to accommodate and position said rib.

* * * * *